US009003581B2

(12) United States Patent
Beumer

(10) Patent No.: US 9,003,581 B2
(45) Date of Patent: Apr. 14, 2015

(54) SUPPORT DEVICE FOR PERSONS, FOR EXAMPLE A HOSPITAL BED, PROVIDED WITH A HYDRAULIC SYSTEM

(71) Applicant: Actuant Corporation, Menomonee Falls, WI (US)

(72) Inventor: Jan Albertus Beumer, Lochem (NL)

(73) Assignee: Actuant Corporation, Menomonee Falls, WI (US)

( * ) Notice: Subject to any disclaimer, the term of this patent is extended or adjusted under 35 U.S.C. 154(b) by 0 days.

(21) Appl. No.: 14/153,936

(22) Filed: Jan. 13, 2014

(65) Prior Publication Data

US 2014/0137329 A1 May 22, 2014

Related U.S. Application Data

(62) Division of application No. 12/933,365, filed as application No. PCT/NL2009/000067 on Mar. 19, 2009, now Pat. No. 8,627,522.

(30) Foreign Application Priority Data

Mar. 19, 2008 (NL) ..... 2001387

(51) Int. Cl.
*A47B 7/02* (2006.01)
*A61G 7/018* (2006.01)
*A61G 7/015* (2006.01)

(52) U.S. Cl.
CPC ..... *A61G 7/018* (2013.01); *A61G 7/015* (2013.01)

(58) Field of Classification Search
CPC ..... A61G 13/02; A61G 13/04; A61G 13/06; A61G 7/018; A61G 7/002
USPC ..... 5/613, 614, 617, 618
See application file for complete search history.

(56) References Cited

U.S. PATENT DOCUMENTS 6,016,580 A 1/2000 Heimbrock et al.
6,421,854 B1 7/2002 Heimbrock
(Continued)

FOREIGN PATENT DOCUMENTS

| | | |
|---|---|---|
| DE | 29815699 | 5/1999 |
| EP | 0341358 | 11/1989 |
| WO | 00/69386 | 11/2000 |

OTHER PUBLICATIONS

International Search Report under date of Jun. 26, 2009 for International Patent Application PCT/NL2009/000067 (2 pages).
(Continued)

*Primary Examiner* — Robert G Santos
*Assistant Examiner* — David E Sosnowski
(74) *Attorney, Agent, or Firm* — Michael Best & Friedrich LLP

(57) ABSTRACT

A support device for persons, such as a bed, treatment or operating table, chair, comprises: a frame; a first and a second movable member, which movable members can be adjusted independently of one another and which are designed to support the person or one or more parts of the person in various positions, and a hydraulic system for adjusting the movable members, the hydraulic system comprising: a reservoir for hydraulic liquid; a first and a second hydraulic actuator associated with the first and second movable member, respectively, which hydraulic actuators can each be moved in two directions; a hydraulic pump; a pump activating member which is operatively connected to the pump in order for an operator to activate the pump; a valve assembly which is provided in the hydraulic circuit between the pump and the respective actuators, and a valve assembly operating member which can be mechanically operated by an operator and is mechanically connected to the valve assembly for selecting and providing a connection between one of the actuators and the pump in order to be able to selectively move a movable member by supplying pressurized hydraulic liquid to the associated actuator upon activation of the pump.

10 Claims, 10 Drawing Sheets

(56) References Cited

U.S. PATENT DOCUMENTS

| | | | | |
|---|---|---|---|---|
| 7,058,998 | B2 | 6/2006 | Diller et al. | |
| 7,412,735 | B2 | 8/2008 | McDaniel et al. | |
| 8,065,764 | B2 | 11/2011 | Kramer | |
| 2006/0031990 | A1 * | 2/2006 | Palmatier et al. | 5/611 |
| 2006/0075558 | A1 * | 4/2006 | Lambarth et al. | 5/611 |
| 2006/0168731 | A1 | 8/2006 | Menkedick et al. | |
| 2007/0163043 | A1 | 7/2007 | Lemire et al. | |
| 2011/0231996 | A1 | 9/2011 | Lemire et al. | |
| 2012/0124745 | A1 | 5/2012 | Heimbrock et al. | |
| 2012/0174319 | A1 | 7/2012 | Menkedick et al. | |

OTHER PUBLICATIONS

Search Report from NL Patent Application 2001387 dated Mar. 19, 2008 (3 pages).

* cited by examiner

SUPPORT DEVICE FOR PERSONS, FOR EXAMPLE A HOSPITAL BED, PROVIDED WITH A HYDRAULIC SYSTEM

RELATED APPLICATIONS

This application is a divisional of co-pending application Ser. No. 12/933,365, filed Dec. 6, 2010, which claims the benefit of PCT International Application No. PCT/NL2009/000067, filed Mar. 19, 2009, which claims the benefit of Netherlands Patent Application No. 2001387, filed Mar. 19, 2008, the entire contents of all of which are hereby incorporated by reference.

FIELD

The present invention relates to a support device for a person, such as a (hospital) bed, treatment or operating table, chair or the like. In particular, the invention provides a support device of this type for use in the medical field, such as in a hospital or other medical establishment, for the transportation of patients (or example in an ambulance), etc.

In a particularly advantageous embodiment, the invention relates to a bed or table (in particular for a hospital) in which a patient is supported essentially in a recumbent position on a supporting surface of the bed or the table. In this case, a hydraulic system is provided for adjusting the height and the orientation of the supporting surface (or one or more sections thereof) of the bed or the table.

BACKGROUND

Hydraulic systems for adjusting hospital beds, for example adjusting of the supporting surface of a hospital bed in which, for example, a mattress is situated on which a patient can lie down, are generally known. For example, in U.S. Pat. No. 4,959,957 a hydraulic unit for adjusting the height of a hospital bed is illustrated. The unit: comprises a single-acting hydraulic actuator and a hydraulic plunger pump. The actuator is coupled to a height-adjustable subframe via a system of rods. The pump is operated by means of a foot-operated lever. The known hydraulic system is furthermore provided with a relief valve which can be operated separately and which relieves the actuator when it is operated, so that the subframe can be lowered.

Another hospital bed with an associated hydraulic system is known from EP 0 341 358 A1. Compared to the system from U.S. Pat. No. 4,959,957, this system comprises a number of additional actuators, each of which is designed to adjust an associated adjustable section of the supporting surface. This known hospital bed has a supporting surface with adjustable back and leg sections, as is very common in practice. The hydraulic system is provided with a hand-operable valve assembly operating member which is designed in such a manner that, by being operated, it selects a specific actuator and connects the latter to the pump in order to thus adjust a specific section of the supporting surface or to set the height of the subframe. The hydraulic system known from EP 0 341 358 A1 is furthermore provided with a pump activating member in the form of a foot-operable lever which is connected to the pump. The purpose of this pump activating member is to actuate the pump so that an actuator which is selected by means of the valve assembly operating member is fed with pressurized hydraulic liquid. In addition, the known hydraulic system is provided with a further, i.e. a third, member which can be operated by an operator and which is connected to a separate relief valve. By operating this third operating member, an operator can produce a connection between a selected actuator and the reservoir and thus a return movement can be carried out.

In order to operate the hydraulic system known from EP 0 341 358 A1, the operator needs at least one of his/her hands to operate the valve assembly operating member. This means that the operator is not able to use both his/her hands (if any) for treating a patient when the operator operates the valve assembly operating member. In many cases, the procedures which have to be carried out on a patient require the use of both hands by the person carrying out the procedure, which is not possible in the case of the hydraulic system known from EP 0 341 358 A1. This may lead to a reduction in care for the patient, require additional care personnel or delay the operation of the hydraulic system (which is undesirable in, for example, hospitals).

The German Utility Model DE 298 15 699 U1 discloses an operating table with hydraulic adjustable members on the supporting surface. The hydraulic system of the operating table from DE 298 15 699 U1 comprises a first lever which can be displaced in a horizontal plane by means of which a hydraulic actuator which is associated with one of the adjustable members can be selected. This lever can be moved into unique positions in order thus to select a specific hydraulic actuator. Like the hydraulic system known from EP 0 341 358 A1, the hydraulic system from DE 298 15 699 U1 comprises a pump activating member in the form of a second foot-operable lever which is connected to the hydraulic pump. In addition, the hydraulic system comprises a third lever which can be foot-operated by an operator and is connected to a separate relief valve. By operating the third lever, the operator can produce a connection between a selected actuator and the reservoir and thus a return movement can be carried out.

A further drawback of both EP 0 341 358 A1 and DE 298 15 699 U1 is that the positioning of the members that can be operated, in particular the foot-operated levers for actuating and relieving the hydraulic actuators, is not satisfactory from an ergonomic point of view. With both the hydraulic system from EP 0 341 358 A1 and DE 298 15 699 U1, said foot-operated levers are arranged in close proximity to one another. This may result in mistakes being made regarding which lever is to be operated by the operator, which may have highly undesirable consequences in the case of a hospital bed.

SUMMARY

It is an object of the present invention to provide a support device for a person with an improved hydraulic system.

It is furthermore an object to provide a support device for a person with a hydraulic system which can be operated easily, intuitively, reliably and quickly, in which the risk of the wrong operating member being operated is as small as possible.

It is a further object of the invention to provide a support device for a person with a sturdy and reliable hydraulic system.

It is a further object of the invention to provide a hospital bed or operating table provided with a hydraulic system for adjusting one or more movable members of the respective bed or table which is simple to operate.

According to a first aspect thereof, the present invention achieves one or more of the above objects by providing a support device for a person, such as a bed, treatment or operating table, chair. The support device comprises a first and a second movable member, which movable members can be adjusted independently of one another and which are designed to support the person or one or more parts of the person in various positions. A hydraulic system is provided for adjusting the first and second movable members, the hydraulic system comprising:

a reservoir for hydraulic liquid, a first and a second hydraulic actuator associated with the first and second movable member, respectively, which hydraulic actuators can each be moved in two directions;

a pump;

a valve assembly which is arranged in the hydraulic circuit between the pump and the respective actuators; and a relief element for removing hydraulic liquid from an actuator.

The support device furthermore is provided with:

a pump activating member which is operatively connected to the pump in order for an operator to activate the pump;

a relief-activating member which is operatively connected to a relief element for removing hydraulic liquid from a selected actuator;

a valve assembly operating member which can be mechanically operated by an operator and is mechanically connected to the valve assembly for providing a connection between a selected actuator and the pump and the relief element, in order to be able to selectively move a movable member by supplying pressurized hydraulic liquid to the selected actuator upon operation of the pump activating member or by removing hydraulic liquid from the selected actuator upon operation of the relief element, respectively.

In the support device; according to the first aspect of the invention, the valve assembly is designed so as to provide a connection between a selected actuator and the reservoir in such a way that the selection of an actuator requires a substantially horizontal displacement of the valve assembly operating member into various positions, so that the operator selects the movable member to be moved by operating the valve assembly operating member and produces the movement by activating the pump activating member and the relief activating member, respectively. In addition, the pump activating member, the relief activating member and the valve assembly operating member are designed and arranged so as to be operated by the operator with his/her foot. In addition, they are provided in a substantially horizontal plane on a side of the support device for persons. In particular, the valve assembly operating member is situated between the pump activating member and the relief activating member. The substantially horizontal displacement of the valve assembly operating member is an operation which is simple to learn and which can be carried out easily, for example when under stress.

The invention is inter alia based on the insight that and has the advantage that by placing the various operating members of the hydraulic system of the device next to one another and in particular by separating the operating members for supplying hydraulic liquid to the actuators or discharging it therefrom as much as possible from one another, yet grouping them together with the operating member for the valve assembly, it becomes possible for an operator to operate the hydraulic system of the device without using his/her hands and results in the risk of mistakes in selecting the direction of movement of the actuators being reduced to a minimum.

Preferably, the valve assembly is a single multi-position valve with a valve body which can be moved at least into a number of positions corresponding to the number of positions of the valve assembly operating member. By using a single valve, the structure is relatively simple and not susceptible to malfunction.

In an advantageous embodiment, an actuator is a single-acting cylinder with a piston rod which can be moved to and fro in a cylinder housing, which delimits a variable chamber in the cylinder housing, with a single main line connection being provided which is connected to the variable chamber, with the cylinder being provided with a hydraulically operated non-return valve with a control pressure line connection which is connected to the relief element and with a main line and a control pressure line being provided between the valve assembly and the actuator, in such a manner that the piston rod of the selected cylinder extends upon activation of the pump and retracts upon activation of the relief element. This embodiment ensures that rupture or leakage of a line does not result in accidental movement of the movable member, for example in lowering of the bed. In a practically advantageous embodiment, all actuators are single-acting actuators.

In a preferred embodiment of the present invention, the reservoir for the hydraulic liquid, the hydraulic pump and the valve assembly are accommodated in a common housing. This eliminates a further drawback of the hydraulic system known from EP 0 341 358 A1.

In the hydraulic system known from EP 0 341 358 A1, the respective parts thereof, in particular the reservoir, the pump and the valve assembly, are distributed over a frame of the hospital bed. In order to incorporate all said parts into a circuit, several hydraulic lines are required in order to connect all parts to one another. This results in a relatively complex system of lines, connections and operating members, which are distributed across said frame. In addition, constructing the known hydraulic system is consequently labour intensive, since all parts have to be fitted and connected separately. In the case of said design of the present embodiment, only the hydraulic lines from and to the actuators have to be fitted to the hospital bed. As a result thereof, it is inter alia possible to deliver the hydraulic system preassembled to whoever produces or assembles the hospital bed, which will result in a significant time saving during assembly.

According to a second aspect thereof, the present invention achieves one or more of the above objects by providing a support device for a person, such as a bed, treatment or operating table, the support device comprising:

a first and a second movable member, which movable members can be adjusted independently of one another and which are designed to support the person or one or more parts of the person in various positions; and a hydraulic system for adjusting the movable members, the hydraulic system comprising:

a reservoir for hydraulic liquid;

a first and a second hydraulic actuator associated with the first and second movable member, respectively, which hydraulic actuators can each be moved in two directions;

a pump;

a valve assembly which is arranged in the hydraulic circuit between the pump and the respective actuators.

The support device furthermore is provided with:

a pump activating member which is operatively connected to the pump in order for an operator to activate the pump;

a valve assembly operating member which can be mechanically operated by an operator and is mechanically connected to the valve assembly for providing a connection between a selected actuator and the pump, in order to be able to selectively move a movable member by supplying pressurized hydraulic liquid to the selected actuator upon operation of the pump.

This device according to the second aspect of the invention provides for the mechanically operable valve assembly operating member for each of the first and the second actuators to be brought into two unique spatial positions, with one unique position corresponding to the connection of this actuator (which is thus also selected) to the pump and the other unique position corresponding to the direction of movement of said selected actuator, so that, by operating the latter, the operator selects the movable member which is to be moved as well as the direction of movement thereof and effects the movement by activating the pump activating member.

As far as its second aspect is concerned, the invention is inter alia based on the insight that now, using a single valve assembly operating member, both the actuator to be operated and its direction of movement can be selected and that, by activating the pump, this movement can be effected.

Preferably, the mechanically operable valve assembly operating member is designed to be able to select all hydraulic actuators of the device, i.e. in the case of three actuators, there would be six unique positions, etc.

In this manner, only two elements which are to be operated by the one or more operators (for example medical personnel) are required in order to carry out all the necessary operations in order, for example, to adjust a supporting surface of a hospital bed. In addition, when selecting the actuator to be actuated, the direction of operation thereof will also have to be selected, so that, upon actuation of the actuator, it is no longer necessary to choose a respective operating member, but only one operating member is available for said purpose.

Preferably, the valve assembly is a single multi-position valve with a valve body which can be moved at least into a number of positions corresponding to the number of unique positions by operating the valve assembly operating member. By using a single valve, the structure is relatively simple and not susceptible to malfunction.

In an advantageous embodiment, the single valve has a valve body which is accommodated in an associated bore in a housing so as to be rotatable about an associated shaft and axially displaceable in the direction of said shaft, with the valve body having two axial positions which can be achieved by axial displacement and, in each axial position, at least two angular positions which can be achieved by rotation, with each of these positions corresponding to a selected actuator and the direction of movement thereof.

Preferably, the valve assembly operating member is designed such that the selection of an actuator requires a substantially horizontal displacement of the valve assembly operating member, and that the selection of the direction of movement of an actuator requires a substantially vertical displacement of the valve assembly operating member. This is an operation which is simple to learn and which can be carried out easily, for example when under stress.

In a practically advantageous embodiment, the valve assembly operating member comprises a lever connected to the valve assembly.

Preferably, the valve assembly operating member is designed and arranged as a member which can be operated by an operator with his/her foot. This is advantageous as the operator can use his/her hands to do other things and/or can keep them clean, for example sterile in the case of medical personnel. This version is particularly advantageous if the activation of the pump is also carried out by foot.

In a practically advantageous embodiment, the pump is a pump which can be operated mechanically by means of a foot lever, the pump preferably being provided with two foot levers which can be operated from different sides of the device.

In an advantageous embodiment, the device is provided with a valve assembly operating member provided in duplicate, so that operation thereof can take place from different sides of the device.

In a particularly advantageous embodiment, an actuator is a single-acting cylinder with a piston rod which can be moved to and fro in a cylinder housing, which delimits a variable chamber in the cylinder housing, with a single main line connection being provided which is connected to the variable chamber, with the cylinder, preferably in the cylinder housing, being provided with a hydraulically operated non-return valve with a control pressure line connection, a main line and a control pressure line being provided between the valve assembly and the actuator, in such a manner that if the valve assembly connects the pump to the main line, the piston rod extends upon activation of the pump, and in such a manner that if the valve assembly connects the main line connection to the reservoir, the non-return valve prevents the hydraulic liquid from the variable chamber from flowing out via the main line to the reservoir, unless the pump is activated. This embodiment ensures that rupture or leakage of a line does not result in accidental movement of the movable member, for example in lowering of the bed. In a practically advantageous embodiment, all actuators are single-acting actuators.

In a preferred embodiment of the present invention, the reservoirs for the hydraulic liquid, the hydraulic pump and the valve assembly are accommodated in a common housing. This eliminates a further drawback of the hydraulic system known from EP 0 341 358 A1.

In the hydraulic system known from EP 0 341 358 A1, the respective parts thereof, in particular the reservoir, the pump and the valve assembly are distributed over a frame of the hospital bed. In order to incorporate all said parts into a circuit, several hydraulic lines are required in order to connect all parts to one another. This results in a relatively complex system of lines, connections and operating members, which are distributed across said frame. In addition, constructing the known hydraulic system is consequently labour intensive, since all parts have to be fitted and connected separately. In the case of said design of the present embodiment, only the hydraulic lines from and to the actuators have to be fitted to the hospital bed. As a result thereof, it is inter alia possible to deliver the hydraulic system preassembled to whoever produces or assembles the hospital bed, which will result in a significant time saving during assembly.

The present invention furthermore relates to a bed or table on which a person can be supported in a recumbent position, in particular a hospital bed, treatment or operating table, with:

- an undercarriage which stands on the ground, preferably a wheeled undercarriage,
- a height-adjustable subframe;
- a supporting surface which is supported by the subframe for supporting a person thereon, for example a patient, at least in a recumbent position, the supporting surface comprising at least one adjustable section for supporting a specific body part of a patient in different orientations,
- a hydraulic system according to one of both aspects of the invention, in which the height-adjustable subframe and the at least one adjustable section of the supporting surface are each separately coupled to a hydraulic actuator of the hydraulic system.

The invention also relates to a hydraulic system which is designed for a support device for persons as explained in this document.

Further advantageous embodiments of the present invention will be described below with reference to the figures, in which identical parts are denoted by the same reference numerals.

BRIEF DESCRIPTION OF THE DRAWINGS

FIG. 1 shows a hospital bed which is generally denoted by reference numeral 1, with reference to which an example or a first embodiment of the present invention will be described.

DETAILED DESCRIPTION

Figure 1:
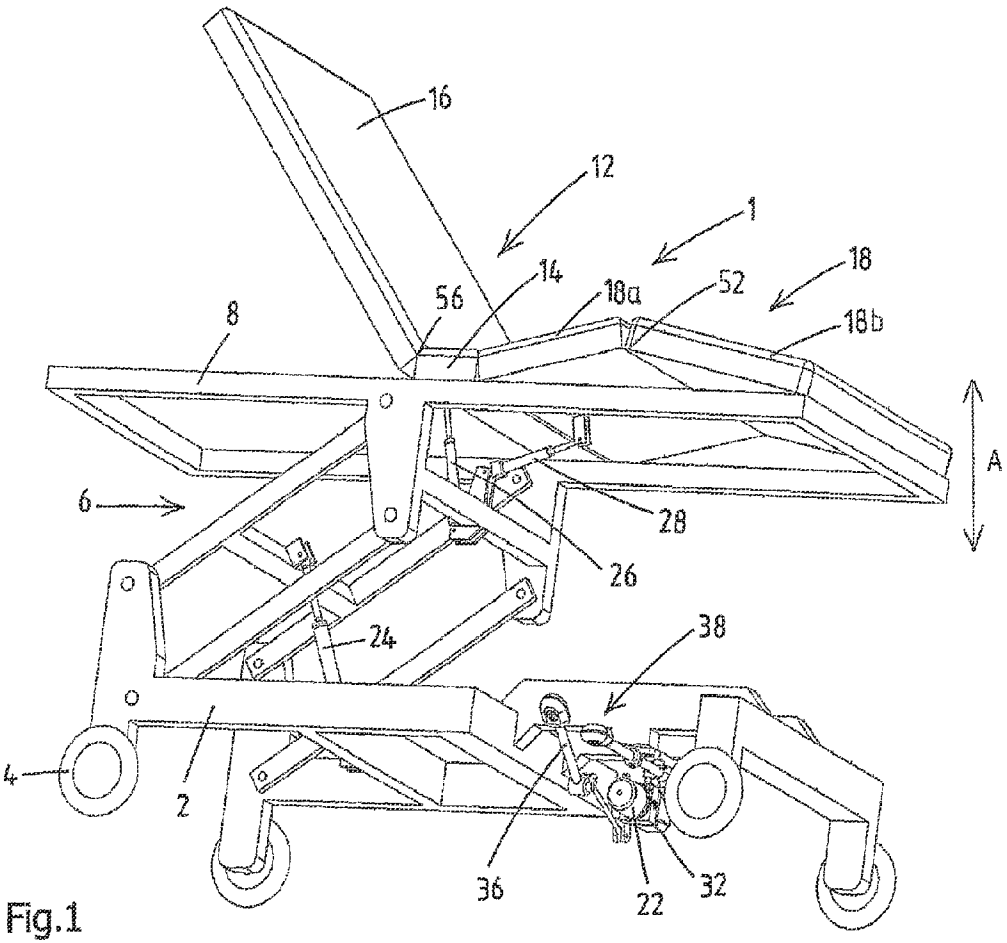
FIG. 1 shows a hospital bed with a hydraulic system according to a first embodiment of the invention.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

The hospital bed 1 comprises a wheeled undercarriage 2 which is provided with wheels 4. By means of a parallelogram structure 6, a height-adjustable subframe 8 is supported on the undercarriage. The subframe 8 in turn supports a supporting surface 12 on which a person can lie. In practice, a mattress can be arranged on the supporting surface 12.

For the sake of keeping the drawing simple, parts which are normally present on a hospital bed 1, such as mattresses, cosmetic panels, etc. have not been shown in the figure.

In the illustrated embodiment, the supporting surface 12 is made up of several sections, in this case a fixedly arranged section 14 for supporting the lower back of a person, an adjustable back section 16 for supporting the back of a person and an adjustable leg section 18 for supporting the legs of a person, which is made up of two parts 18*a,b* in this case.

Figure 5:
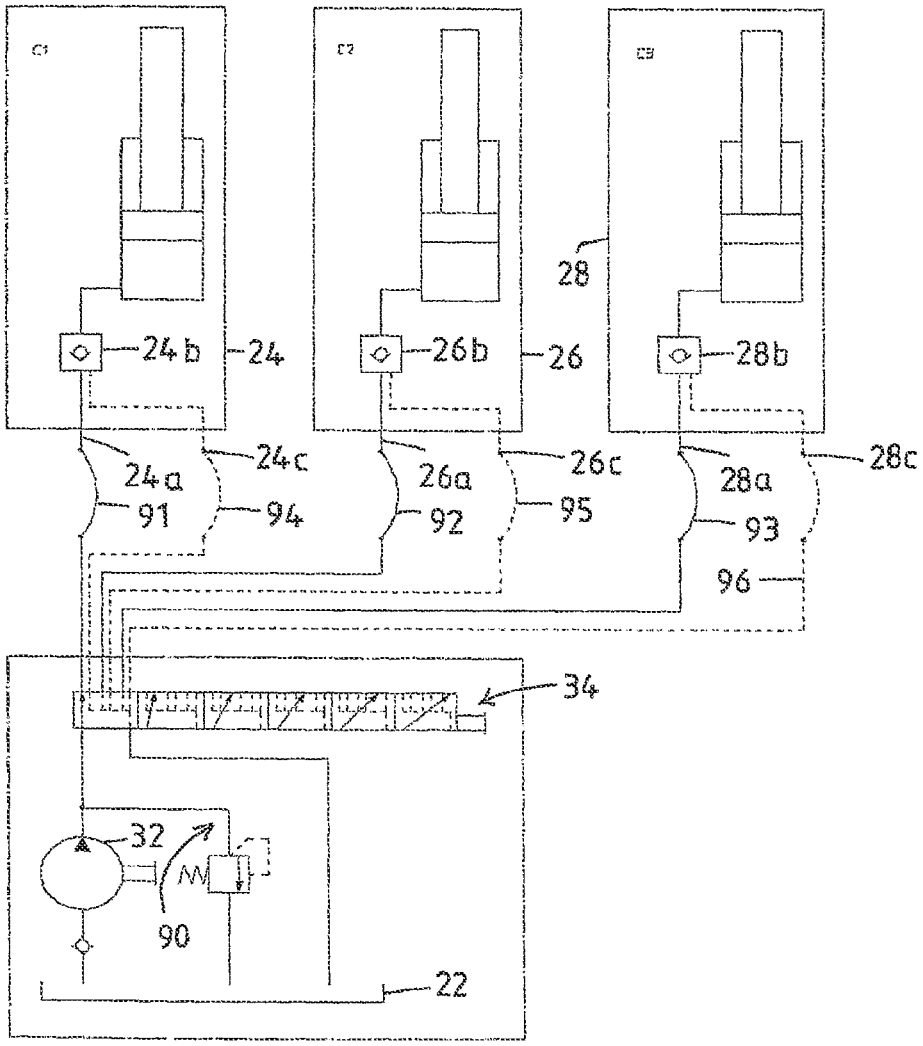
FIG. 5 shows a hydraulic diagram of the bed from FIG. 1.

Furthermore, the hospital bed 1 is provided with at hydraulic system 20, a first preferred embodiment of the hydraulic diagram of which is shown in FIG. 5.

The hydraulic system 20 comprises a reservoir 22 for storing hydraulic liquid therein. Furthermore, the hydraulic system 20 comprises several hydraulic actuators, in this case three 24, 26 and 28, each for driving an associated movable member of the bed 1. If desired, an actuator can also be replaced by a pair of parallel actuators.

The actuators 24, 26, 28 are connected to a hydraulic pump 32 via lines which are not shown in FIG. 1. The hydraulic pump 32 is connected to the reservoir 22 and is designed for supplying pressurized hydraulic liquid to the actuators 24, 26, 28, with the reservoir 22, the pump 32 and the actuators 24, 26, 28 forming a hydraulic circuit.

As is preferred, the pump 32 is a pump which is operated by human force, but could possibly also be an electric pump.

In said hydraulic circuit, a valve assembly 34 is provided between the pump 32 and the actuators 24, 26, 28 which is designed to selectively connect in each case one actuator to the pump 32 or to the reservoir 22 so that a circuit is formed.

Furthermore, a pump activating member 36 is provided in the form of a foot-operable lever which is connected to the pump 32, which is intended exclusively for operating the pump 32.

Furthermore, a valve assembly operating member 38 is provided in the form of a lever which is connected to the valve assembly 34 and is intended exclusively for operating the valve assembly 34.

The valve assembly 34 in the embodiment illustrated in FIG. 1 is designed to select both a selection of the actuators 24, 26, 28 to be actuated and the direction of movement thereof, the latter meaning the extension or retraction of a piston rod of the respective actuator. In this case, the valve assembly 34 is designed to switch on in each case one actuator 24, 26, 28 so that a circuit is formed, that is to say bring ii: into liquid communication with the pump 32 or with the reservoir 22.

This means that the member 38, for each of these switching positions of the valve assembly 34, has a unique spatial position, which position is determined by the operator. By subsequently operating the pump 32, the intended movement is performed.

As is preferred, the valve assembly 34 is designed as a single multi-position valve (a preferred embodiment of which is explained in more detail with reference to FIGS. 4*a,b*) having a single valve body which can assume several positions. Displacement of the valve body is effected by displacement of the lever 38.

As stated, each setting of the multi-position valve of the valve assembly 34 and thus each position of the valve assembly 34 is associated with one unique combination of an actuator and the selected direction of movement thereof.

Because of its direct mechanical connection to the valve assembly 34, the lever 38 connected to the valve assembly 34 thus also always has a unique position which is associated with the position of the valve assembly 34. Therefore, the position of the lever 38 is thus indicative of the selected actuator 24, 26, 28 and the direction of movement thereof.

Various members of the hydraulic system, in particular the reservoir 22, the pump 32 and the valve assembly 34 are preferably accommodated in a single housing, that is to say that at least the respective members are connected to one another in such a way that their respective housings form a substantially single unit. This results in a very compact assembly of hydraulic reservoir, valve assembly and hydraulic pump which can be fitted to the undercarriage 2 of the hospital bed 1 as a single unit.

The internal operation of the valve assembly 34 and in particular the operation of the multi-position valve will be described in more detail with reference to FIGS. 4A and 4B. The operation of the hydraulic system 20 and in particular the adjustment of the hospital bed 1 by means of the hydraulic system 20 will now be explained briefly.

As mentioned, the subframe 8 is adjustable in height and by adjusting the height of the subframe 8, the supporting surface 12 supported thereon can also be adjusted in height. This is desirable, in particular for hospital beds, in order to avoid nursing staff having to bend over very often so as to be able to carry out nursing and/or caring treatments. The height-adjustment of the hospital bed 1 and in particular of the supporting surface 12 is indicated in the figure by a double arrow A.

Adjusting the height of the subframe 8 and thus of the supporting surface 12 is effected by actuating the actuator 24, one end of which is connected to the undercarriage 2 and the other end of which is connected to the structure 6.

Adjustment of the hinged back section 16 takes place by means of actuator 26, one end of which is connected to a subframe 8 and the other end of which, in the example illustrated the free end of a piston rod 26*a* (see FIG. 3A), is connected to the adjustable section 16.

Adjustment of the leg section 18 takes place by means of actuator 28, one end of which is connected to the subframe 8 and the other end of which is connected to a first subsection 18*a* of the leg section 18. The first subsection 18*a* is hingedly connected to a second subsection 18*b* via a hinge 52. It should be noted that the position of hinge 52 will correspond approximately to the location of the knees of a person lying on a mattress arranged on the supporting surface 12 when the hospital bed 1 is in use. The second subsection 18*b* is in turn connected to the subframe 8 by its free end 18*c* via a linear guide. The first subsection 18*a* is hingedly connected to the fixed section 14 via a hinge 56.

Selecting the subsection 16, 18 of the supporting surface 12 to be displaced or selecting the height-adjustment of the subframe 8 is effected by moving the valve assembly 34 into the correct position by means of the lever 38. The selection of the selected actuator 24, 26, 28 is effected by operating the lever 36 by means of a foot.

As has been explained above, the position of the valve assembly 34 and thus the position of the lever 38 by means of which the valve assembly 34 can be operated, is indicative of the selected actuator 24, 26, 28 and the selected direction of movement thereof. This will be explained briefly with reference to FIG. 2.

Figure 2:
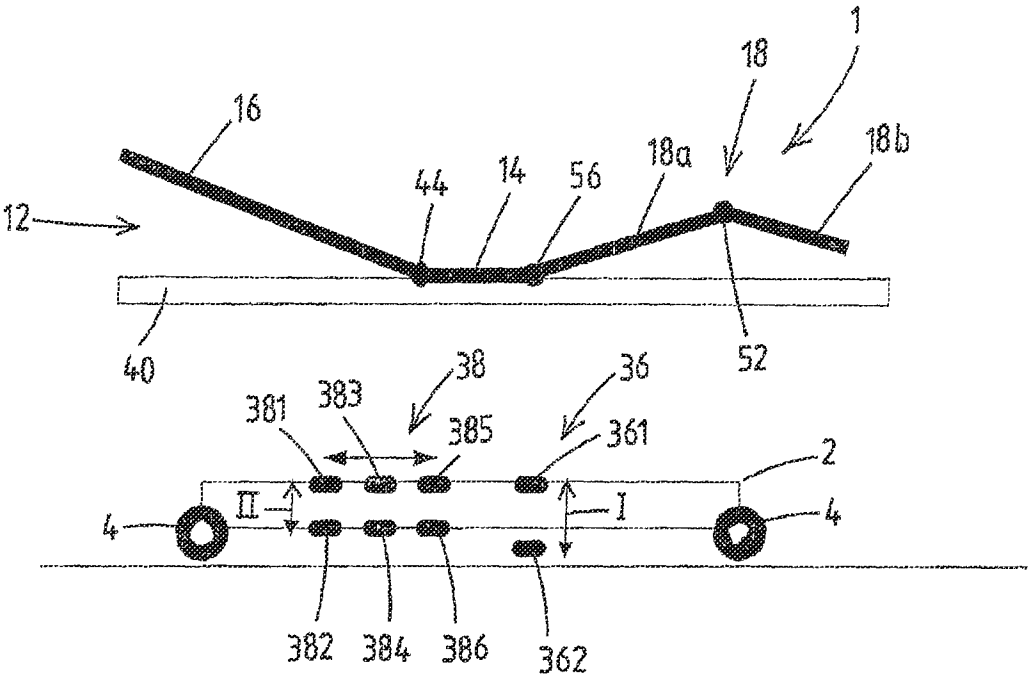
FIG. 2 shows a simplified representation of the hospital bed from FIG. 1.

FIG. 2 shows a highly simplified representation of the hospital bed 1, in which only the supporting surface 12, the subframe 8, the wheeled undercarriage 2 and the levers 36, 38 are represented (in highly diagrammatic form). In this case, the position of the supporting surface 12 substantially corresponds to the position thereof as indicated in FIG. 1. Furthermore, FIG. 2 shows the various sections 14, 16, 18 which can be hinged with respect to one another via the hinges provided, as has been explained above with reference to FIG. 1. For the sake of simplicity of the illustration, the actuators and the hydraulic system for adjusting the hospital bed 1 are not shown in any more detail.

As has been described above, the position of the lever 38, by means of which the valve assembly 34 can be operated, is indicative of the selected actuator 24, 26, 28 and the selected direction thereof. This is illustrated diagrammatically by the positions 381-386 of the lever 38 shown in FIG. 2. Position 381, that is to say the topmost left-hand position in FIG. 2, corresponds to the selection of the actuator 26 with which the back section 16 of the supporting surface 12 can be adjusted upwards (see FIG. 1) in such a manner that operation, that is to say actuation, thereof by operating the lever 36 using a foot, as indicated by arrow I, will rotate the back section 16 about hinge 44 and this will thus be moved upwards. It should be noted that the lever 36 has two limit positions denoted by an upper position 361 and a lower position 362. From the point of view of ease of operation, it is simple and comfortable for a user to press the lever 36 downwards using his/her foot (arrow I), i.e. from the top position 361 to the bottom position 362. To this end, a restoring mechanism (not shown in any more detail) is preferably provided so that, when the lever 36 has been moved to the bottom position 362, the lever 36 is returned to the top position 361 by releasing it or by no longer exerting any force on it with the foot.

A position on the far bottom left-hand side of the lever 38, indicated in FIG. 2 by reference numeral 382, indicates that the actuator 26 is selected, but that operation of the lever 36 will result in the actuator 26 (see FIG. 1) being relieved and thus the back section 16 being lowered. By selecting the bottom position of the lever 38, a connection is made in the valve assembly between the actuator 26 (see FIG. 1) and the reservoir 22 (see FIG. 1) instead of the pump 32 (see FIG. 1). In this way, a person who wants to adjust the hospital bed 1 will recognise a far left-hand position 381, 382 as a position in which the back section 16 will be adjusted when the other lever 36 is operated, which back section 16 is for this person also situated on the left-hand side.

In a completely analogous manner, adjusting the lever 38 to a position 385 at the top right-hand side and a position 386 at the bottom right-hand side corresponds to selecting actuator 28 (see FIG. 1), more particularly to moving the leg section 18 upwards or downwards, respectively. Adjusting the lever 38 to a position 383 at the top centre and a position 383 at the bottom centre, that is to say between the left-hand and right-hand positions of the lever 38 in the figure, corresponds to selecting actuator 24 (see FIG. 1) for adjusting the height of the supporting surface 12. For the sake of clarity, adjusting the lever 38 to a position between a top and bottom position is indicated by arrow II in FIG. 2. In this way, only two operating elements are necessary to carry out all the necessary operations in order to adjust the supporting surface 12 of the hospital bed 1. In addition, it is immediately clear from the position of the lever 38 which actuator will be operated and in which direction.

In a preferred embodiment of the hydraulic system according to the present invention, the pump activating member 36 and the valve assembly operating member 38, in other words the levers 36, 38, are provided in duplicate, in this case in such a manner that they can be operated from each longitudinal side of the bed 1. This is shown in more detail in FIGS. 3A-3C.

Figure 3A:
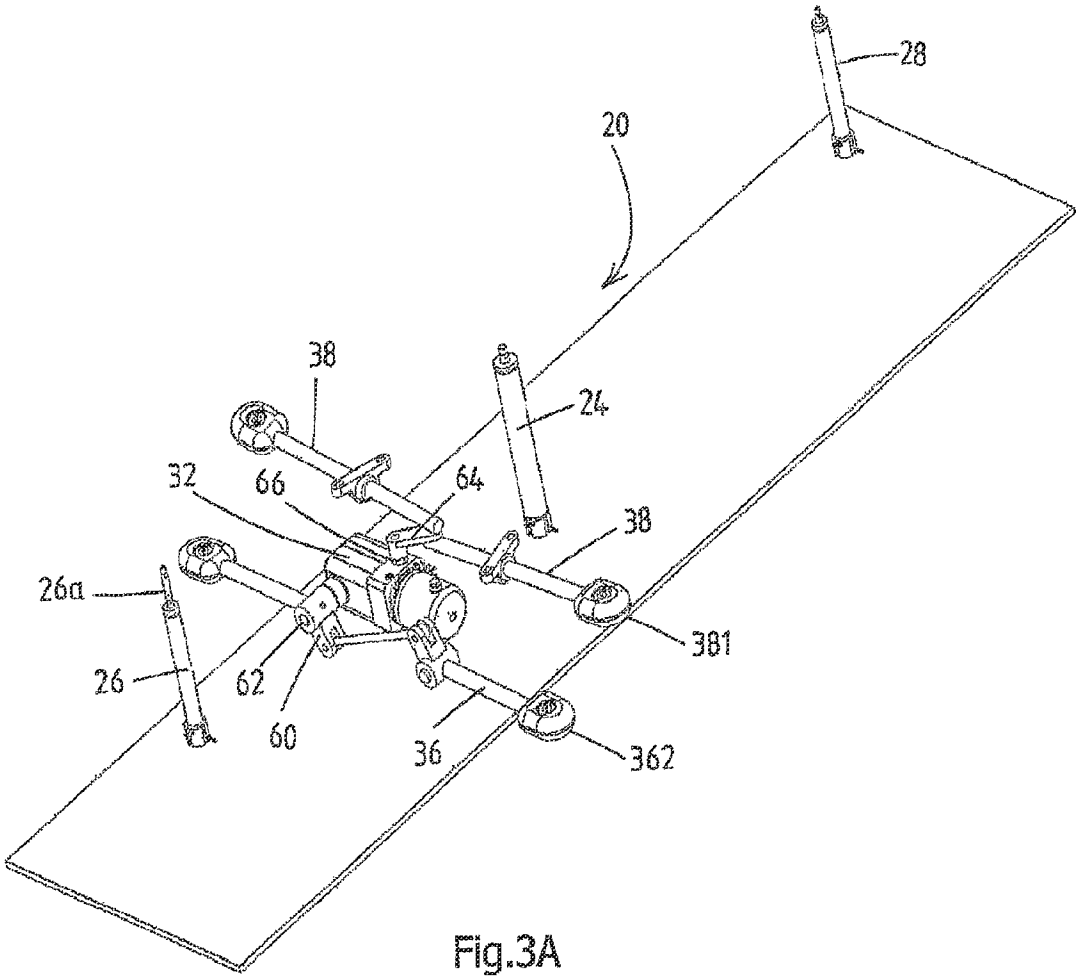
FIG. 3A diagrammatically shows a three-dimensional representation of the hydraulic system with a double valve assembly operating member.

FIG. 3A shows a simplified representation of a hydraulic system 20 according to the present invention. The purpose of the representation in FIG. 3A is only to clarify the operation of the hydraulic system 20. In particular, the spatial distribution of the actuators 24, 26, 28 is only indicated diagrammatically. Thus, for example, the hydraulic lines which connect the actuators 24, 26, 28 and the valve assembly 34 are not shown. FIG. 3A shows that the levers 36, 38 are in this case provided in duplicate. The advantage thereof is that there are operating members on both longitudinal sides of a hospital bed, in this example, as is preferred, foot-operable elements, such as levers, by means of which the hospital bed can be adjusted. As can be seen in the figure, the double lever 36 is connected via a system of rods 60 to a shaft 62 of the pump 32. Via a further system of rods 64, the operating member 38 provided in duplicate is connected to a shaft 66 by means of which a multi-position valve in the valve assembly 34, which valve will be described in more detail below, can be operated.

In the position shown in FIG. 3A, the lever 38 for operating the valve assembly 34 is in the position indicated in FIG. 2 by reference numeral 381. That is to say that when the lever 36 associated with the pump is operated, hydraulic liquid will be supplied to the actuator 26 and the piston rod 26*a* will thus be pushed out of the actuator 26. In addition, FIG. 3A shows that the lever 36 has just been operated as it is in its bottom position 362 (see also FIG. 2).

From the position shown in FIG. 3A, the actuator 26 can be retracted again by moving the lever 38 downwards, as has been described for FIG. 2. This is shown in FIG. 3B.

Figure 3B:
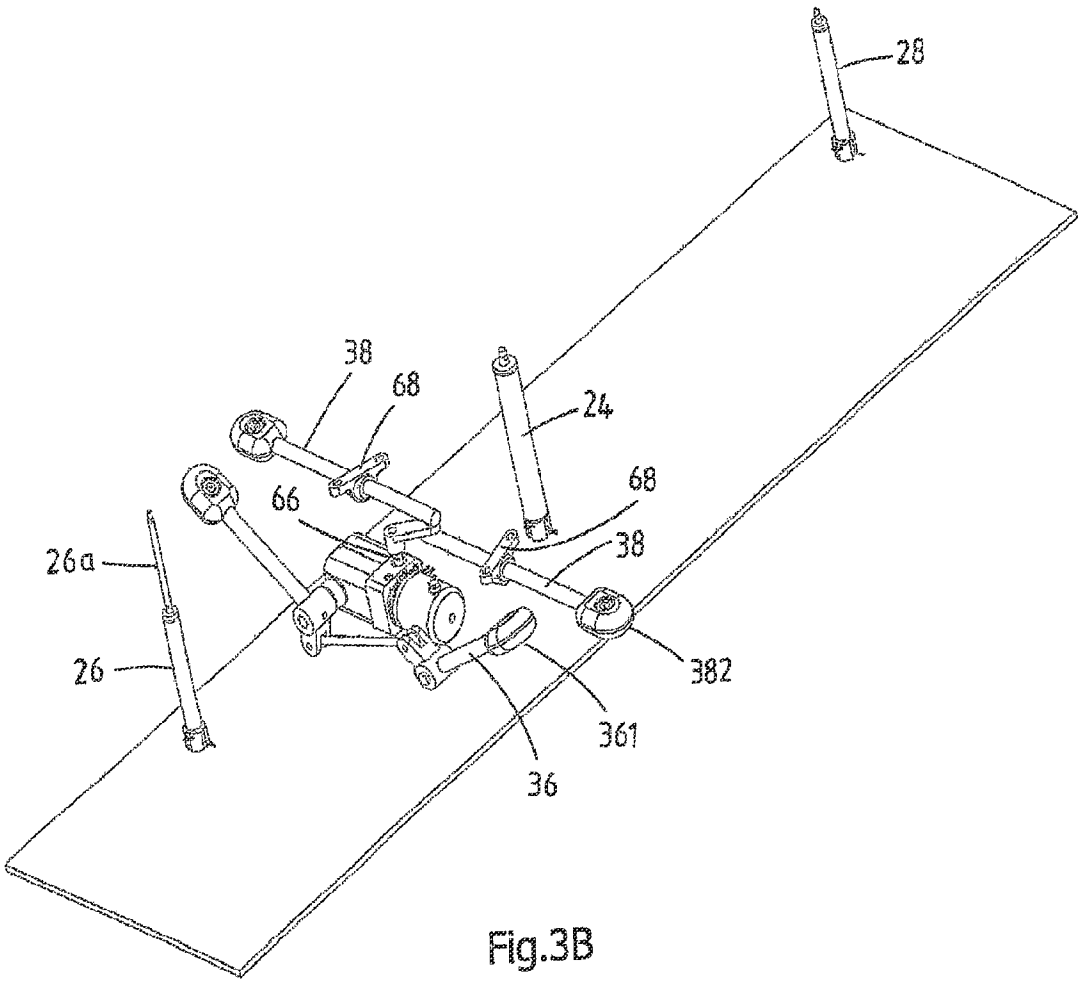
FIG. 3B shows the system from FIG. 3A in a different position thereof.

In FIG. 3B, the lever 38 has been moved downwards to a position which is denoted in FIG. 2 with reference numeral 382. In this position 382, the actuator 26 is connected to the reservoir 22. By moving the lever 36 from position 361 to position 362, the actuator 26 is retracted again under load.

Figure 3C:
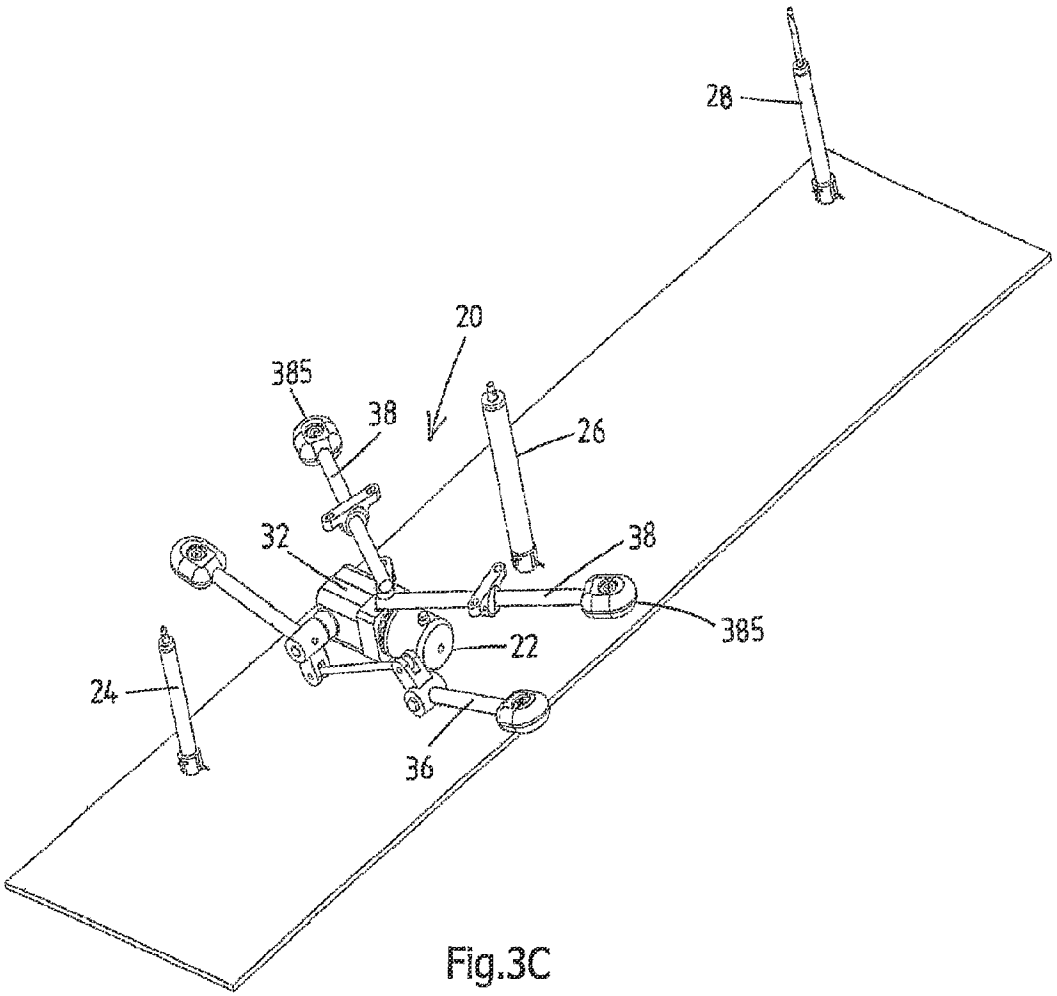
FIG. 3C shows the system from FIG. 3A in yet another position thereof.

As another example of a position of the hydraulic system 20, that is to say a position of the levers 38, FIG. 3C shows the position in which the levers 38 are in position 385 from FIG. 2. In this position, the actuator 28 is actuated when the pump is operated and thus the leg section 18 (see FIG. 2) is moved upwards.

FIGS. 3A to 3C also show that the hydraulic pump 32, the reservoir for hydraulic liquid 22 and the valve assembly 34 (to which all hydraulic lines from and to the piston-cylinder devices 24, 26, 28 which are not shown in the figures are connected) form a single unit.

An example of the valve assembly 34 is shown in more detail in and described with reference to FIGS. 4A and 4B.

Figure 4A:
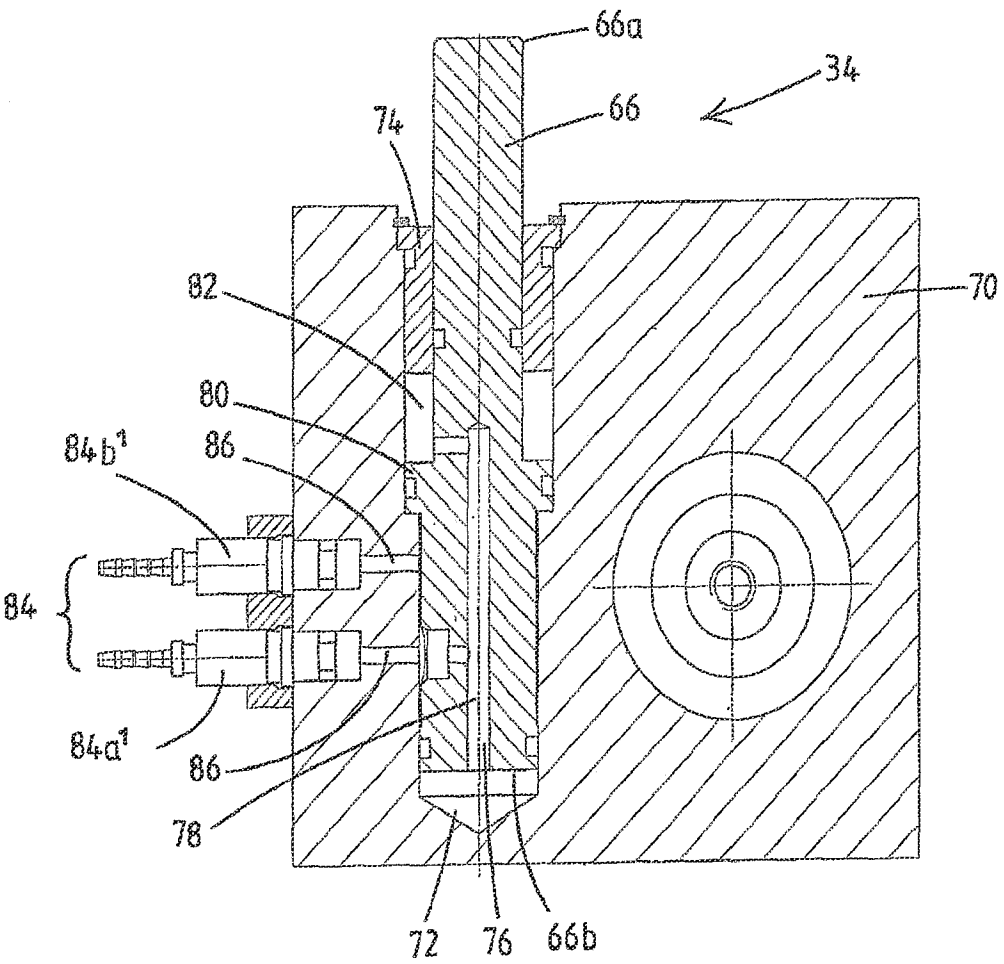
FIG. 4A shows the valve assembly, in cross section and in top view, of the hydraulic system of the first embodiment of the invention.

FIG. 4A shows a valve assembly 34 which is designed as a single multi-position valve in cross-sectional side view. The multi-position valve 34 comprises a valve housing 70 with a blind bore 72 provided therein. The valve body 66 is accommodated in the bore 72 so as to be rotatable about a shaft and to be axially displaceable along the shaft, in which a free end 66*a* of the shaft 66 extends outside the housing 70 and can be connected to the system of rods 64 as described with reference to FIG. 3A. At the location of the free end of the valve body 66, a gland 74 is provided in bore 72. On the one hand, the gland 74 serves to seal the bore 72 and, on the other hand, to seal the interior of the bore 72, in which pressurized hydraulic liquid is situated. A second free end 66*b* of the valve body 66 comprises a mouth 76 of a through-passage 78. The mouth 76 is in communication with a source of hydraulic liquid, so that the hydraulic liquid can flow into the through-passage 78. The through-passage 78 ends in a space 82 between the gland 74 and a collar 80 provided on the valve body 66, which collar 80 serves to seal the space 82. Via the through-passage 78, the space 82 is filled with hydraulic liquid at the same pressure as prevails at the inlet 76. As a result thereof, the play of forces resulting from the pressure in the hydraulic liquid will keep the shaft balanced and the hydraulic pressure which prevails at the second free end 66*b* of the valve body 66 will be balanced out by the same pressure in the space 82 and the valve body 66 will not be pushed out of the housing 70.

In addition, the housing 70 is provided with connection nipples 84, only two of which can be seen in the cross-sectional view from FIG. 4A. The number of pairs of connection nipples corresponds to the number of actuators 24, 26, 28 present. The connection nipples 84 can be connected to hydraulic lines which run to the actuators. Via connecting ducts 86, the connection nipples 84 can be connected to a mouth 88 (see FIG. 4B) in the valve body 66 and thus to the through-passage 78. In the illustrated arrangement, the bottom connection nipple 84*a*1 is in communication with the through-passage 78 and hydraulic liquid can flow through the associated hydraulic line. In view of the configuration of the lever 38 shown in FIGS. 3A to 3C, the valve body 66 is in its bottom position and the lever 38 will be in its highest position (see FIG. 3A) in this example.

Figure 4B:
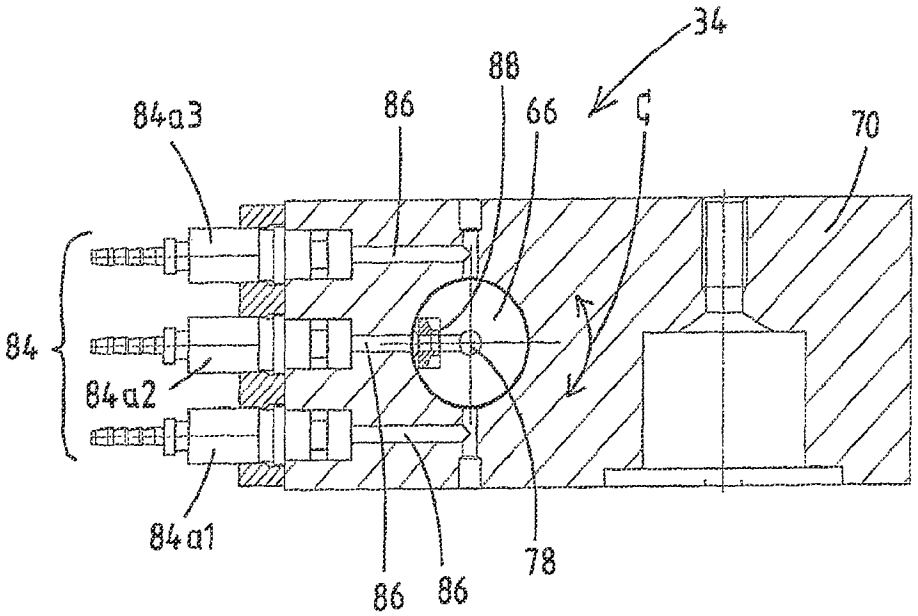
FIG. 4B shows the valve assembly from FIG. 4A in cross sectional side view.

FIG. 4B shows the multi-position valve 34 in cross-sectional side view. In this case, a number of connection nipples 84 are visible which are situated at the same level, that is to say the illustrated connection nipples 84 are all bottom connection nipples or top connection nipples.

For the sake of convenience, it is assumed that, in this case, they are bottom connection nipples 84*a*1, 84*a*2, 84*a*3. The connection nipples 84*a*1, 84*a*2, 84*a*3 can be connected to the connecting ducts 86 which can, in turn, be connected to the mouth 88 in the valve body 66 and thus to the through-passage 78. At their other side, the connection nipples 84*a*1, 84*a*2, 84*a*3 are connected to lines to the respective actuators. In the illustrated example, the central connection nipple 84*a*2 is connected to the through-passage 78. The selection of another actuator is effected by rotating the valve body 66 about its longitudinal axis. This is indicated in the figure by arrow C. By turning the valve body 66 a quarter turn clockwise, connection nipple 84*a*3 will be connected. By turning the valve body 66 a quarter turn anticlockwise, connection nipple 84*a*1 will be connected. In this way, a multi-position valve which is simple to operate is provided.

FIG. 5 shows an example of the hydraulic system as has been discussed above, with pump 32, reservoir 22, the pressure-limiting valve 90 connected to the outlet of the pump 32 in a connection to the reservoir, and with multi-position valve 34. These parts are accommodated in a unit.

Furthermore, the actuators 24, 26, 28 can be seen, which are all designed as single-acting cylinders with a piston rod which can be moved to and fro in a cylinder housing, which delimits a variable chamber in the cylinder housing. A single main line connection 24*a*, 26*a*, 28*a*, is provided for each actuator and is connected to the variable chamber.

Each of the cylinders 24, 26, 28 is furthermore provided with a hydraulically operated non-return valve 24*b*, 26*b*, 28*b* with a control pressure line connection 24*c*, 26*c*, 28*c*.

Between the valve assembly 34 and each of the actuators, there is in each case provided a main line 91, 92, 93, and a control pressure line 94, 95, 96, for example in the form of a hose.

If the valve assembly 34 connects the pump 32 to the main line to an actuator, the piston rod thereof will extend upon activation of the pump.

If the valve assembly 34 connects one of the main line connections 24*a*, 26*a*, 28*a* to the reservoir 32, the non-return valve 24*b*, 26*b*, 28*b* of this respective actuator prevents the hydraulic liquid from flowing out of the variable chamber via the main line to the reservoir. This blocking is only cancelled when the pump is activated, so that a control pressure reaches the respective non-return valve via the control line and opens this valve.

When a line or connection ruptures or leaks, the valves 24*b*, 26*b*, 28*b* ensure that no accidental movement takes place, for example lowering of the bed 1.

It can furthermore be seen that, in this case, each actuator is also provided with a restricted outflow via a throttle and a parallel non-return valve which makes an unrestricted inflow to the variable chamber possible.

Below, an alternative embodiment of the hydraulic system 20 for the hospital bed 1, as shown and described with reference to the preceding figures, will be described with reference to FIGS. 6 and 7. The alternative hydraulic system largely corresponds to the hydraulic system 20 except for the differences to be discussed below.

The inventors have realized that, although the embodiment of the hydraulic system for the hospital bed, as described with reference to the preceding figures, works well and is a significant improvement on the known hospital beds, it is possible, on the one hand, to simplify the valve assembly 34 and, on the other hand, to further improve the operation of the hydraulic system as regards intuitive operation. The inventors have achieved this by no longer configuring the valve assembly 34 so that it selects the actuator 24, 26, 28 to be actuated as well as the direction of movement thereof, but by configuring it solely so that it selects the actuator 24, 26, 28 to be actuated, and by providing a separate relief-activating element which is operatively connected to a non-return valve in an actuator 24, 26, 28 for removing hydraulic liquid from a selected actuator.

Figure 6:
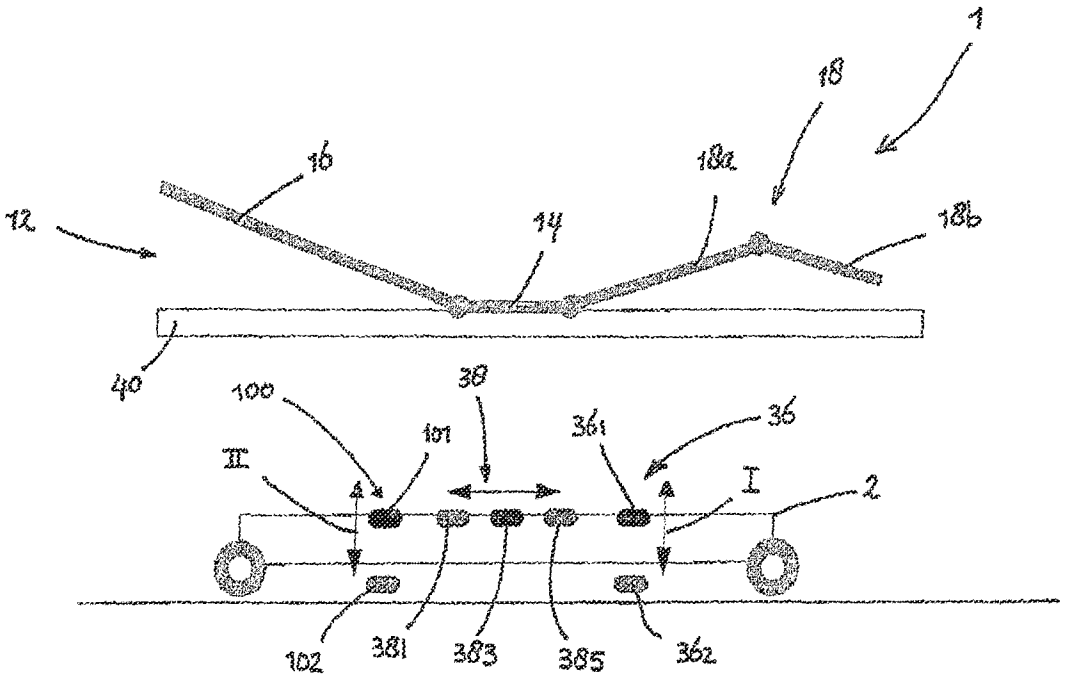
FIG. 6 shows a simplified representation of the hospital bed from FIG. 1 with an alternative hydraulic system.

FIG. 6 shows a highly simplified representation of the hospital bed 1 as discussed with reference to FIG. 2 and with substantially the same members. Compared to the hospital bed from FIG. 2, the hospital bed 1 in FIG. 6 comprises a third operating member 100. The third operating member or relief-activating member 100 is operatively connected to a non-return valve for removing hydraulic liquid from a selected actuator. This will be discussed in more detail with reference to FIG. 7.

As has been discussed before, the position of the lever 38, by means of which the valve assembly 34 can be operated, is indicative of the selected actuator 24, 26, 28. This is shown diagrammatically by means of the positions 381, 383, 385 of the lever 38 illustrated in FIG. 6. Position 381, that is to say the position on the far left-hand side in FIG. 6, corresponds to selecting the actuator 26 with which the back section 16 of the supporting surface 12 can be adjusted (see FIG. 1) in such a manner that operation, that is to say actuation, thereof by operating the lever 36 by foot, indicated by arrow I, will cause actuator 26 to extend and will raise the back section 16, and operation of the lever 100 by foot, indicated by arrow II, will cause actuator 26 to retract and will lower the back section 16. Operating the lever 100 activates, that is to say opens, a non-return valve in the actuator 26 and hydraulic liquid will flow to the reservoir 22 from actuator 26.

It should be noted that lever 36 and lever 100 have two limit positions, denoted as top position 361 and 101, respectively, and bottom position 362 and 102, respectively. From the point of view of ease of operation, it is simple and comfortable for a user to press the levers downwards using his/her foot (arrows I, II), i.e. from the top position to the bottom position. Preferably, a restoring mechanism (not shown in any more detail) is provided for this purpose.

In this manner, the position of the lever 38 is indicative of the member 14, 16, 18*a*, 18*b* to be displaced and two separate levers are provided for, on the one hand, raising and, on the other hand, lowering the selected section. In addition, as can clearly be seen in FIG. 6, the levers for actuating a selected actuator and relieving a selected actuator are (spatially) separated from one another as much as possible, so that there is little chance of an operator making mistakes when operating the hydraulic system.

In an entirely corresponding manner, adjusting the lever 38 to a position 385 on the right-hand side corresponds to the selection of the actuator 28 (see FIG. 1) and in particular to the selection of the leg section 18 for operation. Adjusting the lever 38 to a position 383 in the centre, that is to say between the left-hand and right-hand positions of the lever 38 in the figure, corresponds to selecting the actuator 24 (see FIG. 1) for adjusting the height of the supporting surface 12. Thus, only three operating members are required to carry out all the necessary operations for adjusting the supporting surface 12 of the hospital bed 1. In addition, it is immediately clear from the position of the lever 38 which actuator will be operated.

In a preferred embodiment of the hydraulic system according to the present invention, the pump activating member 36 and the valve assembly operating member 38 or levers 36, 38 are provided in duplicate, in this case in such a manner that the bed 1 can be operated along each longitudinal side.

It should be noted that it will be clear to the person skilled in the art how the valve assembly 34 can be modified in order to be made suitable for a hydraulic system such as that shown in FIG. 6 and such as that which is to be discussed below with reference to FIG. 7.

Figure 7:
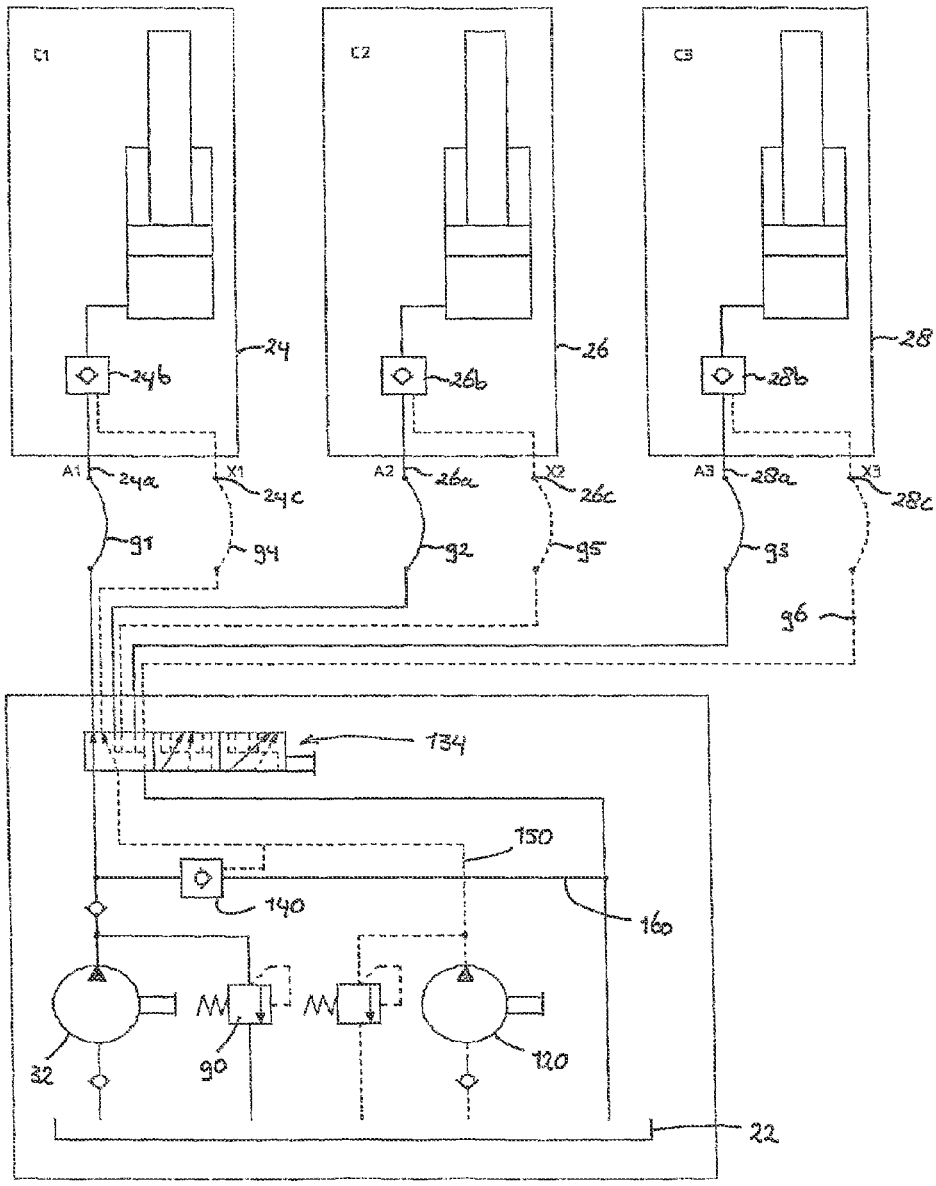
FIG. 7 shows a hydraulic diagram of the hydraulic system of the bed from FIG. 6

FIG. 7 shows an example of the hydraulic system as discussed above with reference to FIG. 6. The hydraulic system shown in FIG. 7 essentially corresponds to the hydraulic system shown in FIG. 5 and comprises the pump 32, reservoir 22, the pressure-limiting valve 90 connected to the outlet of the pump 32 in a connection to the reservoir 22, and a multi-position valve 134. These parts are accommodated in a unit. In addition, a control pressure pump or relief element 120 which is incorporated in a control pressure circuit 150 is provided. A pressure-limiting valve 130 which is in communication with the reservoir 22 is connected to the outlet of the control pressure pump 120. The control pressure pump 120 is operatively connected to and can be operated by the relief operating member or lever 100. Furthermore, the actuators 24, 26, 28 can be seen which are all designed as single-acting cylinders with a piston rod which can move to and fro in a cylinder housing, which delimits a variable chamber in the cylinder housing. A single main line connection 24*a*, 26*a*, 28*a* is provided for each actuator and is connected to the variable chamber.

Each of the cylinders 24, 26, 28 is furthermore provided with a hydraulically operated non-return valve 24*b*, 26*b*, 28*b* with a control pressure line connection 24*c*, 26*c*, 28*c*. Between the valve assembly or multi-position valve 134 and each of the actuators, there is in each case provided a main line 91, 92, 93, and a control pressure line 94, 95, 96, for example in the form of a hose. The control pressure line 150 can be connected to one of the control pressure lines 94, 95, 96 by means of the multi-position valve 134.

Furthermore, the hydraulic system comprises a return line 160 which is connected to the line of the pump 32 and is in communication with the reservoir 22. In the return line 160, a non-return valve 140 is provided which is situated on the control pressure line 150 and can be operated by the control pressure pump 120.

An actuator can be selected by means of the valve assembly 134, as has been described above. Operating, that is to say activating, the pump 32 will cause the selected actuator to extend by the pump 32 supplying hydraulic liquid to the actuator in question. Operating, that is to say activating, the control pressure pump 120 will open the non-return valve of the respective actuator and non-return valve 140, so that hydraulic liquid can flow from the actuator to the reservoir 22 and cause the selected actuator to retract.

When a line or connection ruptures or leaks, the valves 24*b*, 26*b*, 28*b* ensure that no accidental movement takes place, for example lowering of the bed 1.

In a variant (not shown), an actuator may be provided for tilting the subframe in a forward or backward direction.

In another variant (not shown), an emergency operating device is provided for quickly lowering the back section 16, for example in order to carry out reanimation. To this end, a bypass valve could be provided on the actuator 26, if desired with a direct line to the reservoir.

It should also be noted that it is also possible to operate more than the three actuators that are illustrated in each case. This requires a larger number of positions and thus connections on the valve assembly. However, the principle of selecting positions of the valve assembly remains unaffected.

Although the invention has been described above as a hydraulic system which is suitable for adjusting a hospital bed, it will be clear to those skilled in the art that the hydraulic system according to the present invention can also be used for different applications. In particular, the hydraulic system can be used in situations where intuitive operation of actuators is desirable.

What is claimed is:

1. A support device for a person, such as a bed, treatment or operating table, chair, the support device comprising:

a first and a second movable member, which movable members can be adjusted independently of one another and which are designed to support the person or one or more parts of the person in various positions; and a hydraulic system for adjusting the movable members, the hydraulic system including a reservoir for hydraulic liquid, a first and a second hydraulic actuator associated with the first and second movable members, respectively, which hydraulic actuators can each be moved in two directions, a pump, and a valve assembly which is arranged in a hydraulic circuit between the pump and the respective actuators;

the support device furthermore being provided with:

a pump activating member which is operatively connected to the pump in order for an operator to activate the pump; and a valve assembly operating member which can be mechanically operated by an operator and is mechanically connected to the valve assembly for providing a connection between a selected actuator of the hydraulic actuators and the pump, in order to be able to selectively move one of the movable members by supplying pressurized hydraulic liquid to the selected actuator upon operation of the pump, wherein the respective valve assembly is also designed to provide a connection between a selected actuator of the hydraulic actuators and the reservoir, and wherein the mechanically operable valve assembly operating member can be brought into two unique spatial positions for each of the first and the second actuators, whereby for each actuator one unique position corresponds to the connection of the selected actuator to the pump and the other unique position corresponds to the direction of movement of the selected actuator, so that, in operation, the operator selects the movable member which is to be moved as well as the direction of movement thereof and effects the movement by activating the pump activating member.

2. The support device according to claim 1, in which the valve assembly is a single multi-position valve with a valve body which can be moved into at least a number of positions corresponding to the number of unique positions by operating the valve assembly operating member.

3. The support device according to claim 1, in which a valve body is accommodated in an associated bore in a housing so as to be rotatable about an associated shaft and axially displaceable in the direction of said shaft, with the valve body having at least two axial positions which can be achieved by axial displacement and, in each axial position, at least two angular positions which can be achieved by rotation, with each of these positions corresponding to a selected actuator and the direction of movement thereof.

4. The support device according to claim 1, in which the valve assembly operating member is designed in such a manner that the selection of an actuator requires a substantially horizontal displacement of the valve assembly operating member, and that the selection of the direction of movement of an actuator requires a substantially vertical displacement of the valve assembly operating member.

5. The support device according to claim 4, in which the valve assembly operating member is designed and arranged to be operated by an operator with his/her foot.

6. The support device according to claim 2, in which each of the actuators is a single-acting cylinder with a piston rod which can be moved to and fro in a cylinder housing, which delimits a variable chamber in the cylinder housing, with a single main line connection being provided which is connected to the variable chamber, with the cylinder being provided with a hydraulically operated non-return valve with a control pressure line connection, a main line and a control pressure line being provided between the valve assembly and the actuator, in such a manner that if the valve assembly connects the pump to the main line, the piston rod extends upon activation of the pump, and in such a manner that if the valve assembly connects the main line connection to the reservoir, the non-return valve prevents the hydraulic liquid from the variable chamber from flowing out via the main line to the reservoir unless the pump is activated.

7. The support device according to claim 2, in which the pump is designed and arranged to be mechanically operated by means of a foot lever or two foot levers which can be operated from opposed longitudinal sides of the device.

8. The support device according to claim 2, further comprising:

an undercarriage, a height-adjustable subframe, wherein the first hydraulic actuator is coupled to the subframe, and a supporting surface which is supported by the subframe for supporting a person thereon, at least in a recumbent position, the supporting surface comprising at least one adjustable section for supporting a specific body part of the person in different orientations, wherein the second hydraulic actuator is coupled to the adjustable section.

9. The support device according to claim 8, wherein said device is a bed having a head end and a foot end, in which the supporting surface comprises a movable back section and a movable leg section, in which the second hydraulic actuator is coupled to the back section and a third hydraulic actuator is coupled to the leg section, and in which the valve assembly operating member is designed in such a manner that the selection of the second actuator for the back section corresponds to a unique position of the operating member directed towards the head end of the bed and selection of the third actuator for the leg section corresponds to a unique position of the operating member directed towards the foot end of the bed, in which the selection of the direction of movement of the selected actuator can be effected by choosing between two unique positions of the operating member which are at a distance from one another in the vertical direction.

10. The support device according to claim 9, in which the selection of the first actuator for adjusting the height of the subframe corresponds to bringing the operating member into an intermediate unique position, in which the selection of the upward or downward movement can be achieved by choosing between two unique positions of the operating member which are at a distance from one another in the vertical direction.

* * * * *